United States Patent [19]

Goodwin et al.

[11] Patent Number: 4,484,398

[45] Date of Patent: Nov. 27, 1984

[54] SPIKED SHOE PROTECTOR

[76] Inventors: Boyd G. Goodwin; Carol A. Goodwin, both of 1108-16th Ave., NE., Miami, Okla. 74354

[21] Appl. No.: 515,610

[22] Filed: Jul. 21, 1983

[51] Int. Cl.[3] ..... A43B 23/00

[52] U.S. Cl. ..... 36/135; 36/127; 36/73

[58] Field of Search ..... 36/7.5, 127, 135, 73, 36/72 R

[56] References Cited

U.S. PATENT DOCUMENTS

| | | | |
|---|---|---|---|
| 1,260,901 | 3/1918 | Hayhurst | 36/7.5 X |
| 1,958,107 | 5/1934 | Merrill et al. | 36/135 X |
| 2,801,478 | 8/1957 | Gilbert | 36/135 X |
| 2,958,963 | 11/1960 | Lougheed | 36/127 X |
| 3,243,902 | 4/1966 | Chapman | 36/135 X |
| 3,566,488 | 3/1971 | Pilarski | 36/7.5 |

FOREIGN PATENT DOCUMENTS

| | | | |
|---|---|---|---|
| 491842 | 6/1928 | Fed. Rep. of Germany | 36/135 |

*Primary Examiner*—Henry S. Jaudon
*Assistant Examiner*—Tracy G. Graveline
*Attorney, Agent, or Firm*—Head, Johnson & Stevenson

[57] ABSTRACT

A protector for encasing at least a portion of the cleats or spikes normally provided on the sole of an athletic shoe, or the like, and comprising a substantially flat body portion adapted to be disposed adjacent the outer surface of the sole, the body portion being provided with a plurality of transversely extending, longitudinally spaced channels for encasing at least a portion of the cleats, the channels being provided with strengthened outer surfaces for engaging the surface of the underfoot terrain for supporting the cleats in spaced relation thereto, thus protecting the terrain from damage by engagement with the cleats, the body portion having gripping elements engagable with either the cleats or with complimentary gripping elements provided on the shoe for removably securing the protector to the shoe in a manner facilitating both the installation and removal of the protection therefrom.

9 Claims, 5 Drawing Figures

SPIKED SHOE PROTECTOR

BACKGROUND OF THE INVENTION

1. Field of the Invention

This invention relates to improvements in shoe protectors and more particularly, but not by way of limitation, to a protector for the sole of shoes having outwardly extending spikes or cleats secured thereto.

2. Description of the Preferred Embodiment

Many athletic shoes are provided with outwardly extending spikes or cleats on the soles thereof for facilitating the playing of the game for which the shoe has been particularly constructed. For example, the usual golfing shoe is provided with a plurality of spikes or cleats on the sole thereof which enable the golfer to maintain a more secure and efficient stance when approaching or striking the ball. As a general rule, these spikes or cleats are relatively sharp and create considerable damage to the usual floor when the shoes are worn under circumstances requiring the golfer to be away from the terrain of the golf course, or the like. It is frequently neccessary to prohibit the wearing of these shoes in the clubroom, or the like, which is frequently associated with the golf course, and the disadvantages of this requirement will be apparent.

In order to overcome this problem, many removable covers or protectors have been devised for installation on the spiked sole of an athletic shoe, such as those shown in the Degge U.S. Pat. No. 1,811,781; Friedenberg U.S. Pat. No. 2,032,052; Beals, Jr. U.S. Pat. No. 2,076,316; Lougheed U.S. Pat. No. 2,958,963; McCann U.S. Pat. No. 3,020,654; Pilarski U.S. Pat. No. 3,566,488; Goodman U.S. Pat. No. 3,812,603, and the Hogue U.S. Pat. No. 4,258,483. Most of these devices have disadvantages, however, in that they are difficult to install on the shoe. By way of example, most of these devices encase not only the entire sole of the shoe, but also encase at least a sufficient portion of the lower part of the shoe itself for holding the device securely in position. The usual material from which the devices are constructed is yieldable, and installing the device around the outer periphery of the lower portion of the shoe may be quite tedious. The use of these devices is generally more difficult than merely changing the entire shoe itself prior to walking on a surface which may be damaged by the cleats.

SUMMARY OF THE INVENTION

The present invention contemplates a novel protector for the soles of spiked or cleated shoes, the protector having been particularly designed and constructed for overcoming the foregoing disadvantages. The novel protector comprises a substantially flat main body portion having a plurality of longitudinally spaced, transversely extending channels for encasing at least a portion of the spikes or cleats of the sole. The channels not only preclude engagement of the sharp outer portions of the cleats with the walking surface, but also elevate the entire shoe sole whereby any uncovered or unprotected cleats will be held in spaced relation to the walking surface. At least one aperture may be provided in the main body for receiving a cleat therethrough whereby the walls of the aperture securely engage the cleat for removably securing the protector in position on the sole. In this manner, the protector may be quickly and easily installed in position against the outer surface of the sole. Alternatively, it may be desirable to provide upstanding flap means on the main body portion, the flap means being adapted to be secured to the upper portion of the shoe itself by suitable gripper means. In any event, the protector may be quickly and easily "snapped" into position against the cleated sole of the shoe. In order to remove the protector from engagement with the sole, it is merely necessary to apply sufficient pressure on the protector in a direction away from the sole to disengage the cleat or cleats from the respective aperture, or in the event the flap means is utilized, the gripper means may be readily disengaged for releasing the engagement of the protector with the shoe. The novel protector is simple and efficient in operation and economical and durable in construction.

DETAILED DESCRIPTION OF THE PREFERRED EMBODIMENT

Figure 1:
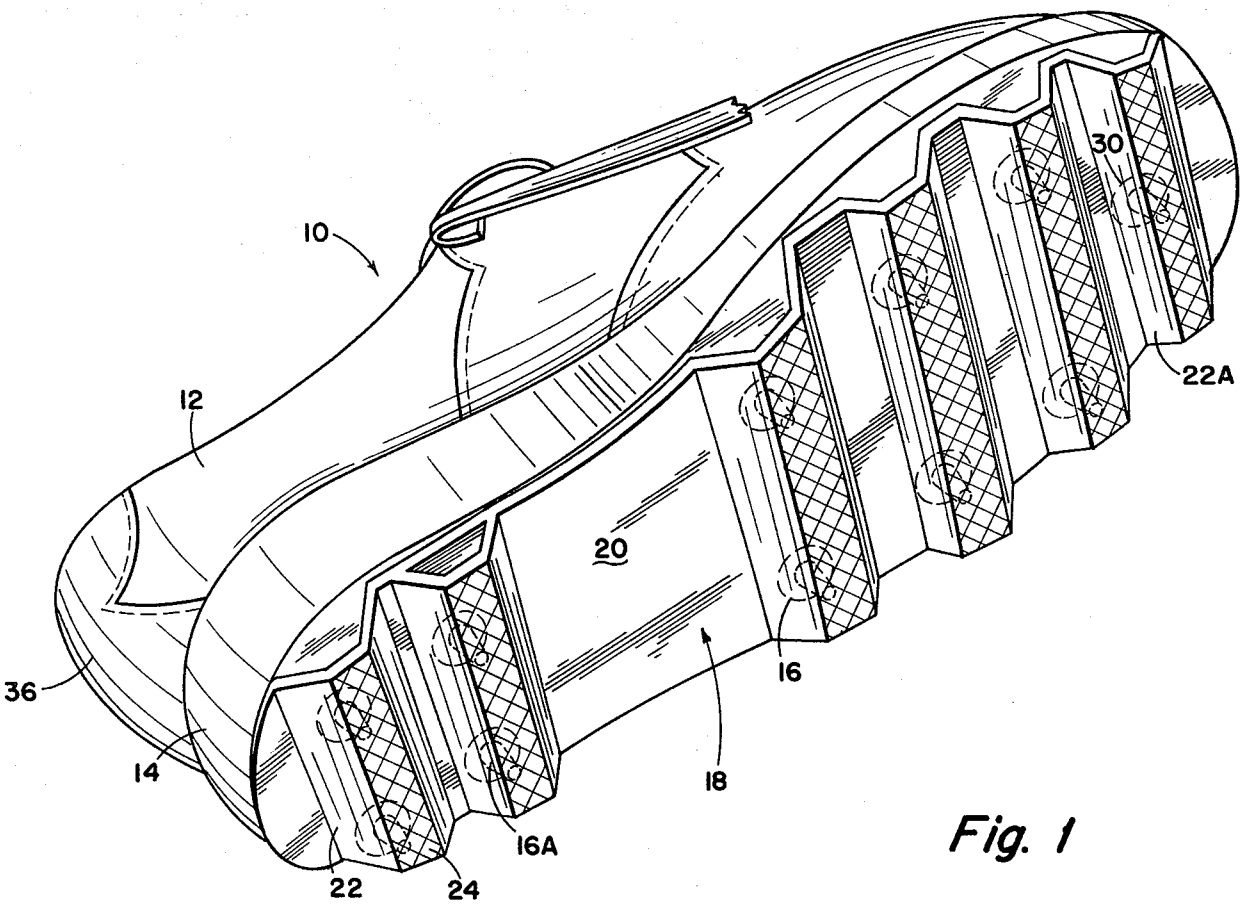
FIG. 1 is a perspective view of a shoe having a sole protector embodying the invention installed thereon.

Referring to the drawings in detail, reference character 10 generally indicates an athletic shoe, or the like, comprising the usual upper portion 12 and sole 14 secured thereto in any well known manner. The sole 14 is provided with a plurality of spaced spikes or cleats 16 secured thereto in any suitable manner, such as by a threaded connection whereby worn or damaged cleats may be replaced if required. Of course, the cleats 16 may be rigidly secured to the sole, if desired.

Figure 4:
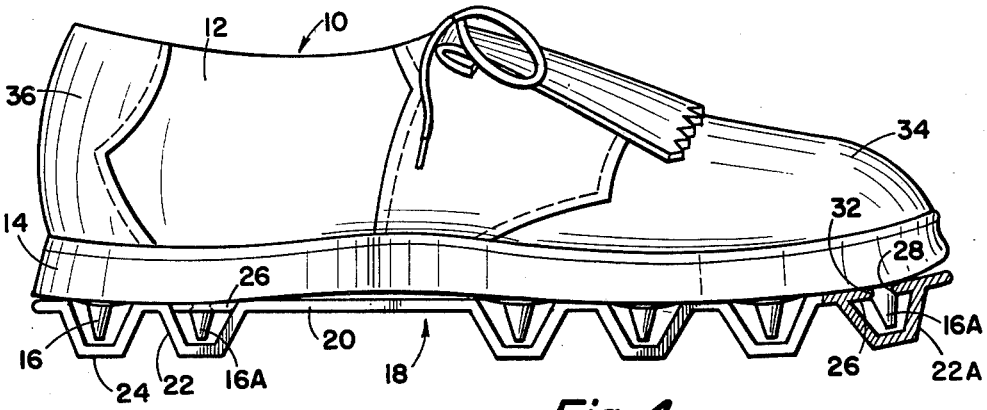
FIG. 4 is a side elevational view, partly in section, of the shoe and protector shown in FIG. 1.

A sole protector means generally indicated at 18 may be removably secured to the outer face or surface of the sole 14 for encasing or covering at least a portion of the cleats 16 in order to facilitate using the shoe 10 when walking upon a surface (not shown) which might be damaged by engagement thereof by the cleats 16. As particularly shown in FIGS. 1 and 4, the protector means 18 is preferably constructed from a suitable yieldable material, such as rubber, neoprene, plastic, or the like, but not limited thereto, and comprises a substantially flat main body portion 20 adapted to be removably disposed adjacent or in the proximity of the outer surface of the sole 14. The configuration of the outer periphery of the body 20 is preferably of a configuration generally corresponding to the configuration of the outer periphery of the sole 14, but not limited thereto. A plurality of longitudinally spaced, transversely extending channels 22 are provided on the body 20, and are so arranged as to cover or encase the cleats 16. Each of the channels 22 is preferably of a substantially flattened V-shaped cross-sectional configuration whereby a substantially flat, elongated planar surface 24 is provided at the flattened portion of the Vee. The surface of portion 24 is preferably constructed from a suitable rubber, neoprene or the like, and may be scored or otherwise "roughened" if desired for engaging the surface of the walking surface (not shown) during use of the device 18.

Each of the channel members 22 is open at the inner longitudinally extending side thereof and at least one of the channels, such as the channel 22A (FIG. 4) is provided with a membrane or web means 26 spanning the width thereon in the proximity of one of the cleats, such as the cleat 16A. The web means 26 is provided with an aperture 28 for receiving the cleat 16A therethrough, and the cleat 16A is preferably of a particularly selected construction for engagement by the aperture 28 for securely retaining the web 26 in position thereon, thus removably securing the protector 18 in position against the outer surface of the sole 12. The cleats 16A are substantially identical with the usual removable cleat normally provided on the athletic shoes 10, and comprise the usual outwardly extending circumferential flange 30 having the cleat 16A extending axially outwardly therefrom. The cleat 16A, however, has been altered to provide an annular recess 32 around the outer periphery thereof and disposed in the proximity of the outer face of the flange 30. The annular recess 32 receives the aperture 28 therein to securely retain the web 26 in engagement with the cleat 16A. Of course, it may be preferable to provide a plurality of the cleats 16A and complimentary webs 26 for removably securing the protector 18 in position against the outer surface of the sole 14.

In use, the protector 18 may be easily "snapped" into the protective position against the outer surface of the sole 14 by engaging at least one aperture 28 with the recess 32 of at least one cleat 16A. It is preferable, however, to provide one cleat 16A in the proximity of the toe portion 34 of the shoe 10 and a pair of cleats 16A in the proximity of the heel portion 36 of the shoe 10. With the protector 18 thus removably secured to the outer surface of the sole 14, the cleats 16 and 16A will be encased by the respective channels 22 and 22A, and the tread surfaces 24 will engage the surface of the terrain or walking area when walking thereon with the shoes 10 having the protectors 18 thereon. When it is desired to restore the shoes 10 to the cleated or spiked mode therefor, the protector 18 may be quickly and easily removed from engagement with the cleats 16A by exerting sufficient manual force on the body 20, or the like, in a direction away from the shoe 10 for "unsnapping" the webs 26 from the respective cleats 16A.

Figure 2:
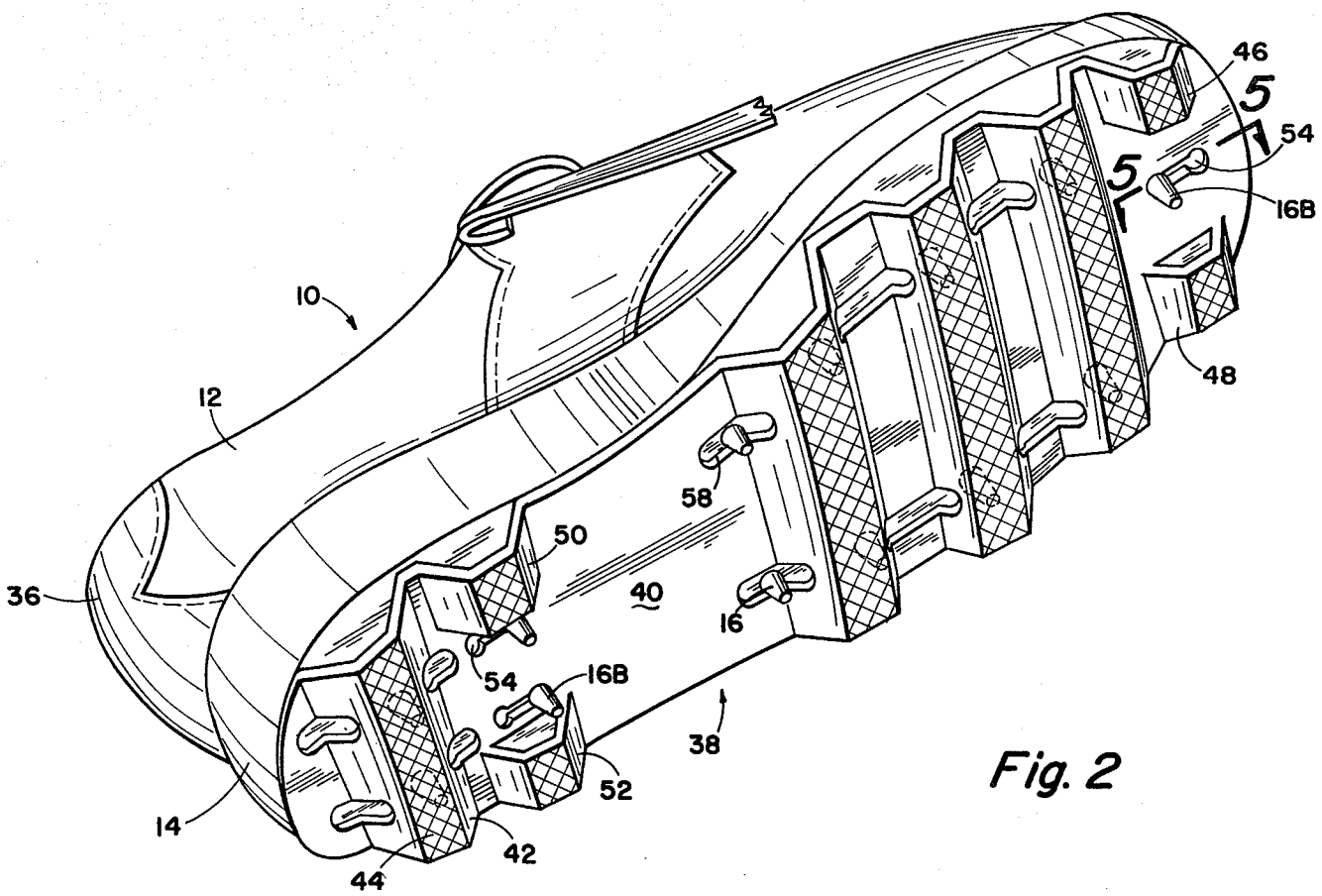
FIG. 2 is a perspective view of a shoe having a modified sole protector embodying the invention installed thereon.
Figure 5:
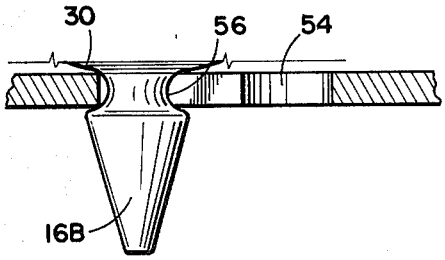
FIG. 5 is an enlarged view taken on Section 5—5 of FIG. 2.

Referring now to FIGS. 2 and 5, reference character 38 generally indicates a modified cleat protector comprising a substantially flat main body portion 40 generally similar to the body portion 20, and having the outer periphery thereof of a configuration substantially corresponding to the configuration of the outer periphery of the sole 14. A plurality of longitudinally spaced transversely extending elongated channels 42 generally similar to the channels 22 are provided on the body 40 and are preferably of a substantially flattened V-shaped cross-sectional configuration. The elongated flattened outer surface 44 of each channel 42 is constructed from a suitable rubber, neoprene, or the like, and scored, or otherwise roughened to provide surfaces for engaging the terrain or walking surface (not shown) wherein the shoe 12 and protector 38 are to be utilized, as hereinbefore set forth. In addition to the channel members 42, it is preferable to provide at least one pair of spaced outwardly extending relatively short channel members 46 and 48 on the outer surface of the body 40, and as particularly shown in FIG. 2, it may be preferable to provide a second pair of spaced similar short channel members 50 and 52. The channel members 46 and 48 are disposed on opposite sides of one of the cleat members 16, such as the cleat 16B for supporting the protector member 38 from the walking surface at a height greater than the length of the cleat. In this manner, the cleat is held above the walking surface and out of engagement therewith.

A substantially key-hole shaped slot or aperture 54 is provided in the body 40 interposed between the channel members 46 and 48 for receiving the cleat 16B therethrough, and the cleat 16B is preferably of a configuration similar to the cleat 16A wherein an annular recess 56 (FIG. 5) is provided around the outer periphery of the cleat in the proximity of the circumferential flange 30. The edge of the key-slot 54 engages the recess 56 for securely retaining the body 40 in position adjacent or against the outer surface of the sole 16. Of course, the key-slot 54 permits a certain adjustability of the position of the protector 38 with respect to the position of the cleats on the sole 14, thus assuring that the protector 38 may be utilized with substantially any desired athletic shoe 10. Of course, whereas the channels 42 may completely encase at least a portion of the cleats 16, it may be that the particular spacing between the cleats 16 on some brands of the shoe 10 may differ considerably from the spacing on other brands thereof. In order to compensate for such variances in cleat spacing, a plurality of longitudinally extending elongated slots 58 may be provided in the body 40 in association with each of the channels 42 for receiving a cleat 16 therethrough. Since the supporting surfaces 44 hold the entire sole 14 in spaced relation with respect to the surface of the terrain, or the like, wherein the person wearing the shoe 10 and protector 38 is walking, the cleats 16 will be maintained out of engagement with the walking surface, thus protecting the surface from damage by the cleats. Of course, it may also be desirable to provide key slots 54 between the second pair of channel members 50 and 52, each key slot 54 for receiving a cleat 16B therethrough.

In use, the protector member 38 may be applied to the outer surface of the sole 14 in a manner generally similar to that set forth in connection with the protector 18. The key slot or slots 54 may be engaged with the respective cleats 16B for removably securing the protector in position against the outer surface of the sole, and may be easily and quickly removed by exerting sufficient force against the body 40 in a direction away from the shoe 10 for disengaging the cleats 16B from the respective key slots 54.

Figure 3:
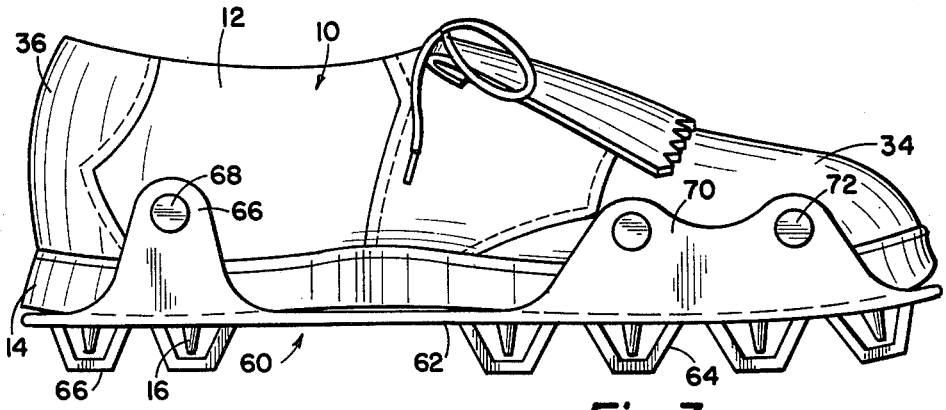
FIG. 3 is a side elevational view of a shoe having another modified protector embodying the invention installed thereon.

As shown in FIG. 3, reference character 60 generally indicates a further modified cleat protector comprising a substantially flat main body portion 62 similar to the body portions 20 and 40. A plurality of longitudinally spaced transversely extending channel members 64 are provided on the outer surface of the body 60 for encasing the cleats 16. The channel members 64 are preferably of a substantially flattened V-shaped cross-sectional configuration as hereinbefore set forth, with a walking surface 66 provided on the flattened outer end of each Vee, as hereinbefore set forth. A first upstanding flap means 66 is provided on the outer periphery of the body 62 in the proximity of the heel 36, with a substantially identical flap means (not shown) being provided on the opposite side of the body 62. Each flap 66 is provided with a suitable gripping element 68 for releasable engagement with a complimentary gripping element (not shown) provided on the outer periphery of the shoe 10. A second upstanding flap means 70 is provided on the outer periphery of the body 62 in the proximity of the toe 34 of the shoe 10, and a substantially identical flap means (not shown) is provided on the opposite side of the body 62. Each flap 70 is provided with suitable gripping elements 72 for releasable engagement with complimentary gripping elements (not shown) provided on the shoe 10.

In order to install the protector 60 on the shoe 10, the body 62 may be placed adjacent or in the proximity of the outer surface of the sole 14 in such a manner that at least some of the cleats 16 are encased by the channels 64. The flap means 66 on both sides of the body 62 may be snapped together with the respective gripping elements (not shown) of the shoe 10, and the flap means 70 may be similarly "snapped" onto the gripping elements (not shown) of the shoe 10. Of course, the complimentary gripping elements may be disengaged in the usual manner for releasing the protector 60 from engagement with the shoe when desired.

From the foregoing it will be apparent that the present invention provides a novel protector for use with athletic shoes having spikes or cleats provided on the soles thereof. The novel protector comprises a main body means provided with longitudinally spaced transversely extending channel means for encasing at least a portion of the cleats and supporting the sole of the shoe in spaced relation with respect to a walking surface whereby any exposed cleats will be maintained in spaced relation with respect to the walking surface, thus protecting the walking surface from damage due to engagement thereof by the cleats. The protector may be quickly and easily snapped onto the shoe for encasing at least a portion of the cleats and may be quickly and easily removed from engagement with the shoe in order that the shoe may be utilized for its intended purpose.

Whereas the present invention has been described in particular relation to the drawings attached hereto, it should be understood that other and further modification, apart from those shown or suggested herein may be made within the spirit and scope of this invention.

What is claimed is:

1. A protector for a shoe having outwardly extending cleat means provided on the sole thereof, the protector comprising a substantially flat main body portion adapted for disposition adjacent the outer surface of the sole, a plurality of longitudinally spaced outwardly extending open ended channel means provided on the body portion and extending transversely thereacross, one longitudinal side of each channel means being open to the outer surface of the sole for encasing at least a portion of the cleats, and fastening means cooperating between the main body portion and the shoe for removably securing the protector to the shoe.

2. A protector as set forth in claim 1 wherein the fastening means comprises web means provided in at least one of the channel members and spanning at least a portion of the open side thereof, and aperture means provided in the web means for yieldable engagement with a complimentary cleat means for removably securing the protector to the shoe.

3. A protector as set forth in claim 1 wherein each channel means is of a substantially flattened V-shaped cross-sectional configuration.

4. A protector as set forth in claim 3 wherein the flattened portion of each channel means is strengthened to provide a support surface for the protector and shoe whereby the cleat means is maintained in spaced relation to a walking surface upon which the shoe and protector are utilized.

5. A protector as set forth in claim 1 wherein the channel means includes at least one pair of relatively short spaced channel members disposed on opposite side of at least one cleat means, the channel means having a height greater than the height of the cleat means.

6. A protector as set forth in claim 5 and including aperture means provided in the body portion in association with the said pair of short spaced channel members for receiving a complimentary cleat means therethrough.

7. A protector as set forth in claim 6 wherein the aperture means associated with the pair of short spaced channel members is of a key-hole configuration.

8. A protector as set forth in claim 1 and including aperture means in association with at least a portion of the channel means for receiving complimentary cleat means therethrough, the channel means being of a height greater than the height of the cleat means whereby the cleat means is maintained in spaced relation with respect to a walking surface upon which the shoe and protector are utilized.

9. A protector as set forth in claim 1 wherein the fastening means comprises flap means secured to the body portion, and gripper means cooperating between the flap means and shoe for removably securing the protector to the shoe.

* * * * *